United States Patent [19]

Svagerko

[11] Patent Number: 4,792,319

[45] Date of Patent: Dec. 20, 1988

[54] BUILDING BLOCKS

[76] Inventor: Daniel E. Svagerko, 69 Lovell Ave., Mill Valley, Calif. 94941

[21] Appl. No.: 71,011

[22] Filed: Jul. 8, 1987

[51] Int. Cl.[4] ..... A63H 33/06

[52] U.S. Cl. ..... 446/104; 446/115; 446/128

[58] Field of Search ..... 446/115, 116, 104, 120, 446/124, 108, 112, 117, 121, 85, 111, 128; D21/108; 428/33; 434/211

[56] References Cited

U.S. PATENT DOCUMENTS 2,776,521 1/1957 Zimmerman ..... 446/115
4,253,268 3/1981 Mayr ..... 446/104

FOREIGN PATENT DOCUMENTS 0121433 10/1984 European Pat. Off. ..... 446/120

*Primary Examiner*—Mickey Yu
*Attorney, Agent, or Firm*—Larry D. Johnson

[57] ABSTRACT

The invention provides a basic building piece capable of combining with other, identical basic building pieces to form three-dimensional geometric models of the five regular polyhedrons (tetrahedron, hexahedron, octahedron, dodecahedron, and icosahedron), or more accurately, the Archimedean counterparts or truncated versions of these polyhedrons, as well as structures based on combinations of these solids, and other irregular and complex solids and shells. The basic building piece comprises a flat, generally hexagonal member carrying three types of fastening devices on its edges and surfaces to enable the desired variety of connection configurations with other, identical building pieces, and the structures resulting therefrom. In one embodiment, completed forms utilize the interplay of transparent colored pieces to create aesthetic patterns and multicolor relationships.

14 Claims, 13 Drawing Sheets

BUILDING BLOCKS

BACKGROUND OF THE INVENTION

1. Field of the Invention

This invention relates generally to building units for the creation of geometric structures, and more specifically to an improved building piece for educational and entertainment model building kits for expressing geometric principles, aesthetic patterns, and color relationships.

2. Description of the Prior Art

Numerous manufacturers of toy and craft items have developed modular construction systems having building elements of various shapes and sizes, including standard building blocks, "Tinkertoy" brand of post-and-solid elements, "Erector Set" brand of beam and connector elements, and "Lego" brand of variable connectable solids. Other systems provide construction pieces that can be interconnected together to form a variety of construction shapes, in both two and three dimensional configurations.

None of the currently existing construction toy and craft items utilize a single piece design to generate Archimedean and Platonic solids, as well as more complex and irregular forms, to provide modular interconnectivity, and to produce an interplay of transparent primary and secondary color effects.

SUMMARY OF THE INVENTION

The building block system of this invention provides a basic building piece capable of combining with other, identical basic building pieces to form three-dimensional geometric models of the five regular polyhedrons (tetrahedron, hexahedron, octahedron, dodecahedron, and icosahedron), or, more accurately, the Archimedean counterparts or truncated versions of these polyhedrons, as well as structures based on combinations of these solids. The basic building piece comprises a flat, generally hexagonal member carrying three types of fastening means on its edges and surfaces to enable the desired variety of connection configurations with other, identical building pieces, and the structures resulting therefrom.

The first type of fastening means carried on the basic building piece is the piece connector, which is carried on three alternate (non-adjacent) edges of the six-edged hexagonal basic building piece. These piece connectors are used to join any two or more basic building pieces together in edge-to-edge engagement, and enable hinged movement of the joined pieces from coplanarity to either side of non-coplanarity. The piece connectors serve to join the basic building pieces together to form the three basic building units of the invention. Alternatively, these same piece connectors can also be utilized to join basic building pieces together to create a limitless variety of irregular and complex geometric shapes and/or solids.

The three basic building units constructible from the basic building pieces are as follows. First, a truncated tetrahedron can be constructed from four basic pieces, and yields a solid with four faces and four triangular truncations. Next, a truncated octahedron can be constructed from eight basic pieces, and yields a solid with eight faces and six square truncations. Finally, a truncated icosahedron can be constructed from twenty basic pieces, and yields a solid with twenty faces and twelve pentagonal truncations. It should be noted that the truncated octahedron also defines a truncated hexahedron (cube), a solid with six square "faces" (the truncations of the truncated octahedron) and eight hexagonal "truncations" (the faces of the truncated octahedron), and that the truncated icosahedron also defines a truncated dodecahedron, a solid with twelve pentagonal "faces" (the truncations of the truncated icosahedron) and twenty hexagonal "truncations" (the faces of the truncated icosahedron).

The second type of fastening means carried on the basic building piece is the unit connector, which is carried on the three alternate (non-adjacent) edges of the six-edged hexagonal basic building piece not occupied by the piece connectors. The unit connectors are used to join like types of the three basic building units to one another (e.g., truncated tetrahedron to truncated tetrahedron) in truncated surface-to-truncated surface engagement (end-to-end engagement). These unit connectors similarly join together the edges of the basic building pieces used to make the basic building units together, and the unit connectors enable the hinged relative movement of the building units, when only one pair of the respective edges of the truncated surfaces are joined. When the building units are brought into complete end-to-end engagement, the remaining respective edges of the truncated surfaces become joined, and the building units then become detachably locked into place, providing structural rigidity and integrity to the assembled structure. This ability to hinge feature is important in that it enables the basic building units (or other constructed solids) to join together in other than complete end-to-end engagement, greatly enhancing the combination possibilities with other pieces or solids.

The third type of fastening means carried on the basic building piece is the face connector, which is carried on the exposed (outside) planar surface of each of the hexagonal basic building pieces. The face connectors are used to join any two basic building pieces together, whether they are free-standing, bart of a basic building unit, or in any combination of pieces or units, in planar surface-to-planar surface engagement (face-to-face engagement). The face connectors may be designed to enable "pure" face-to-face engagement (like orientation of faces, i.e., alignment of the respective piece connector edges of the first basic building piece with the piece connector edges of the second basic building piece, and the unit connector edges of the first basic building piece with the unit connector edges of the second basic building piece, brought directly together as mirror images), "offset" or rotated face-to-face engagement (unlike orientation of faces, with one face rotated sixty degrees relative to the other, i.e., alignment of the piece connector edges of the first basic building piece with the unit connector edges of the second basic building piece, brought together), or both.

In the preferred embodiment, the unit connector fastening means is positioned on the respective edges of each basic building piece to double as a face connector to accomplish the "pure" type of face-to-face engagement, while the planar-surface mounted face connector is used exclusively for the "offset" type of face-to-face engagement. This configuration simplifies the design and construction of the basic building piece, while still enabling the full range of joining possibilities.

The basic building piece can of course be manufactured from any suitable, formable material. In the preferred embodiment, the pieces are manufactured from a clear plastic material, such as polycarbonate, which can be pigmented to yield building pieces of a variety of colors and in any desired degree of transparency. In this way, specific pieces can be used to represent particular portions of a represented structure, e.g., different atoms in a molecule. Furthermore, combinations of pieces can be used to demonstrate important and interesting color relationships. For example, a truncated tetrahedron basic building unit constructed from transparent pieces representing the primary colors (red, yellow, and blue, and one clear piece to complete the structure), would exhibit these colors and the secondary colors (orange, violet, and green) as light passes through the structure from different orientations. In addition, the basic building pieces can be made opaque, or with one or both surfaces mirrored, to yield even more variety in the solids that can be constructed.

BRIEF DESCRIPTION OF THE DRAWINGS

FIG. 3 is a front elevation view of a pair of truncated tetrahedron basic building units joined in rotated face-to-face engagement;

FIG. 4 is a front elevation view of a pair of truncated tetrahedron basic building units joined in face-to-face engagement;

FIG. 5 is a front elevation view of a series of five truncated tetrahedron basic building units joined in face-to-face engagement;

FIG. 6 is a front elevation view of a pair of truncated tetrahedron basic building units joined in end-to-end engagement; and FIG. 7 is a front elevation view of a series of five truncated tetrahedron basic building units joined in end-to-end engagement;

FIG. 9 is a front elevation view of a pair of truncated octahedron basic building units joined in rotated face-to-face engagement;

FIG. 10 is a front elevation view of a pair of truncated octahedron basic building units joined in face-to-face engagement; and FIG. 11 is a front elevation view of a pair of truncated octahedron basic building units joined in end-to-end engagement;

DETAILED DESCRIPTION OF A PREFERRED EMBODIMENT

Figure 1:
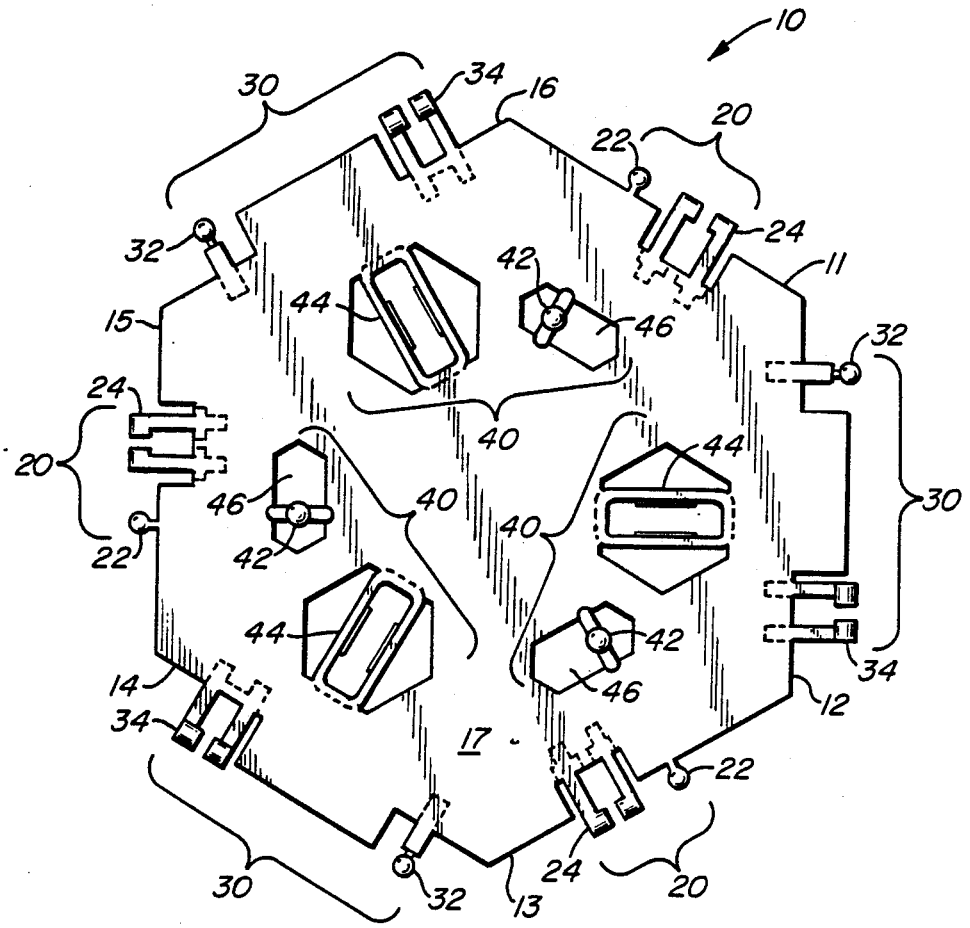
FIG. 1 is a front elevation view of a single hexagonal basic building piece of this invention.

FIG. 1 is a front elevation view of a single hexagonal basic building piece 10. Piece 10 does not replicate a true hexagon, but rather is just an approximation, with its six edges 11, 12, 13, 14, 15, and 16 staggered somewhat for clearance and connections. Piece 10 can be formed as a molded hexagonal sheet of polycarbonate or other suitable material, and can of course be made in any size. In the preferred embodiment, piece 10 is approximately three inches (eight centimeters) wide, and weighs approximately six grams.

Piece 10 includes three types of fastening means. Piece connectors 20 are carried on three alternate edges 11, 13, and 15, and comprise conventional snap-together components such as a ball 22 and a socket 24, that can mate with their complementary ball and socket components on other piece connectors on a separate hexagonal piece. These piece connector components are preferably positioned towards the center of the edges they occupy, to avoid interference with the unit connectors, as will be described infra.

The second type of fastening means carried on hexagonal piece 10 are the unit connectors 30, which are carried on the three remaining alternate edges 12, 14, and 16 not occupied by the piece connectors. The unit connectors can similarly comprise conventional snap-together components such as a ball 32 and a socket 34, that can mate with their complementary ball and socket components on other unit connectors on a separate hexagonal piece. These unit connector components are preferably positioned towards the respective ends of the edges they occupy, to avoid interference with the piece connectors. Thus, the unit connectors do not occupy the same portion of their edge as do the piece connectors on their edge, and vice versa. This relative lateral offset of the two types of connectors is important in that it enables identical connectors to engage one another (e.g., piece connector to piece connector), while not interfering with the engageability of the other types of connectors with one another (e.g., unit connector to unit connector).

The third type of fastening means carried on hexagonal piece 10 are the face connectors 40, carried on the front (outside) surface 17 of piece 10. The face connectors can similarly comprise conventional snap-together components such as a ball 42 and double-bar socket 44, that can mate with their complementary ball and double-bar socket components on other face connectors on a separate hexagonal piece. A key feature of this arrangement is that these face connectors interlock when the faces of a pair of hexagonal pieces are placed together with unlike edges aligned (e.g., piece connector edges aligned with unit connector edges). However, when the faces of a pair of hexagonal pieces are placed together with like edges aligned (e.g., piece connector edges aligned with piece connector edges, etc.), the face connectors do not interlock in standard fashion, but rather the balls 42 nest in clearance holes 46. In such alignment, the unit connectors 30, previously described, act as face connectors. This feature is significant in that it enables both "pure" face-to-face engagement of the hexagonal pieces (like edges aligned, with the unit connectors acting to lock the faces together), and rotated or "offset" face-to-face engagement of the hexagonal pieces (unlike edges aligned, with the face connectors acting to lock the faces together).

Figure 2:
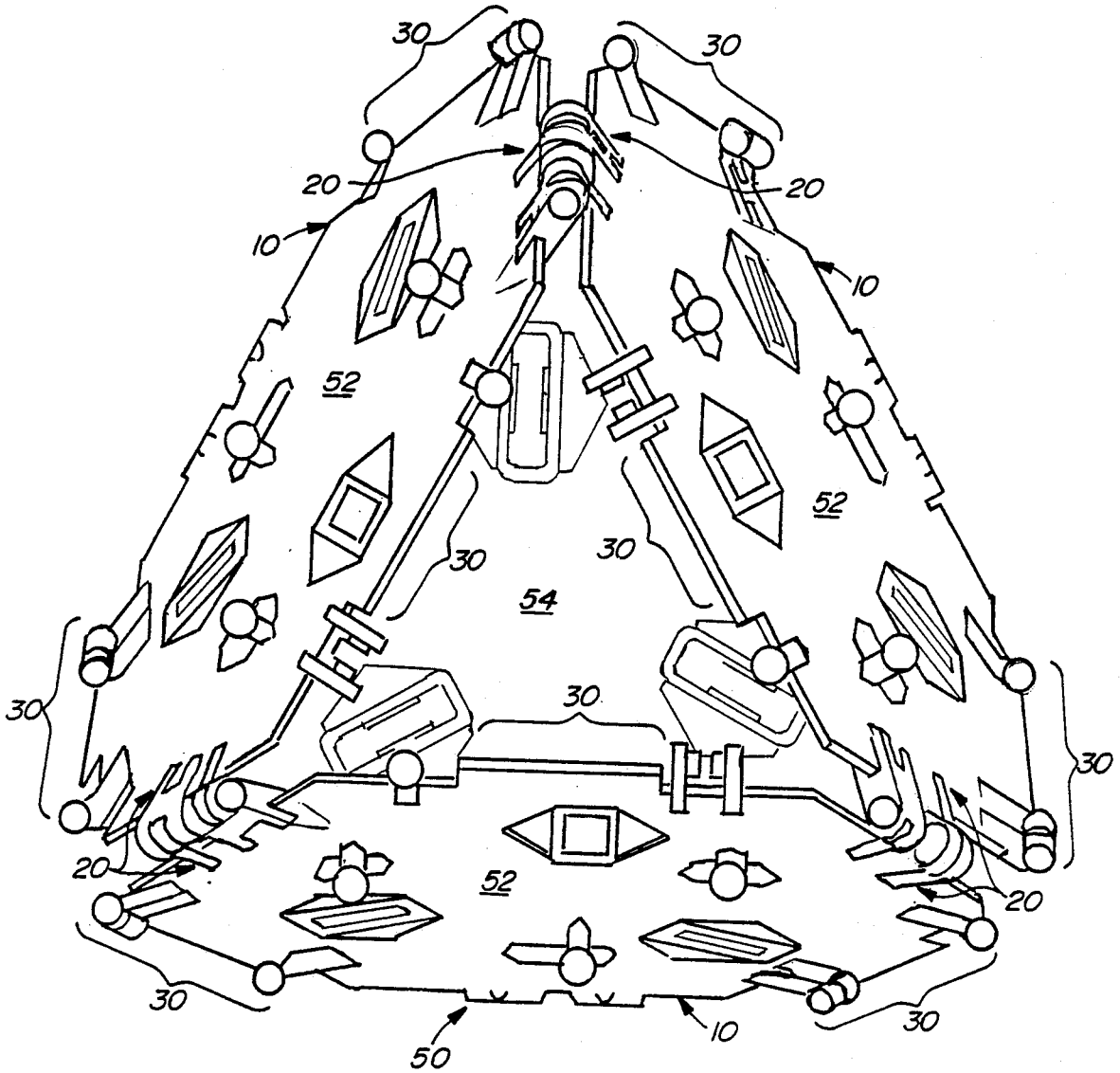
FIG. 2 is a front elevation view of a truncated tetrahedron basic building unit created from the edge-to-edge engagement of four hexagonal basic building pieces of FIG. 1.

FIG. 2 is a front elevation view of a truncated tetrahedron basic building unit 50 created from the edge-to-edge engagement of four hexagonal basic building pieces 10. In this view, respective piece connectors 20 can be seen to be engaged to form the connected edges to define the four hexagonal surfaces 52 of the truncated tetrahedron 50, while the unit connectors 30 are not so engaged, but rather form the edges to define the four triangular truncations 54 of the truncated tetrahedron The piece connectors 20 are preferably positioned on the hexagonal piece 10 so that they occupy space and make their connections slightly to the inside surface of the plane of the piece. This positioning avoids having the connectors contact one another when the hexagonal piece is placed in either kind of face-to-face engagement with another piece. Also, this positioning enables the resultant edges of the constructed solid 50 to be cleaner and without undesirable protrusion of the connectors themselves.

Figure 3:
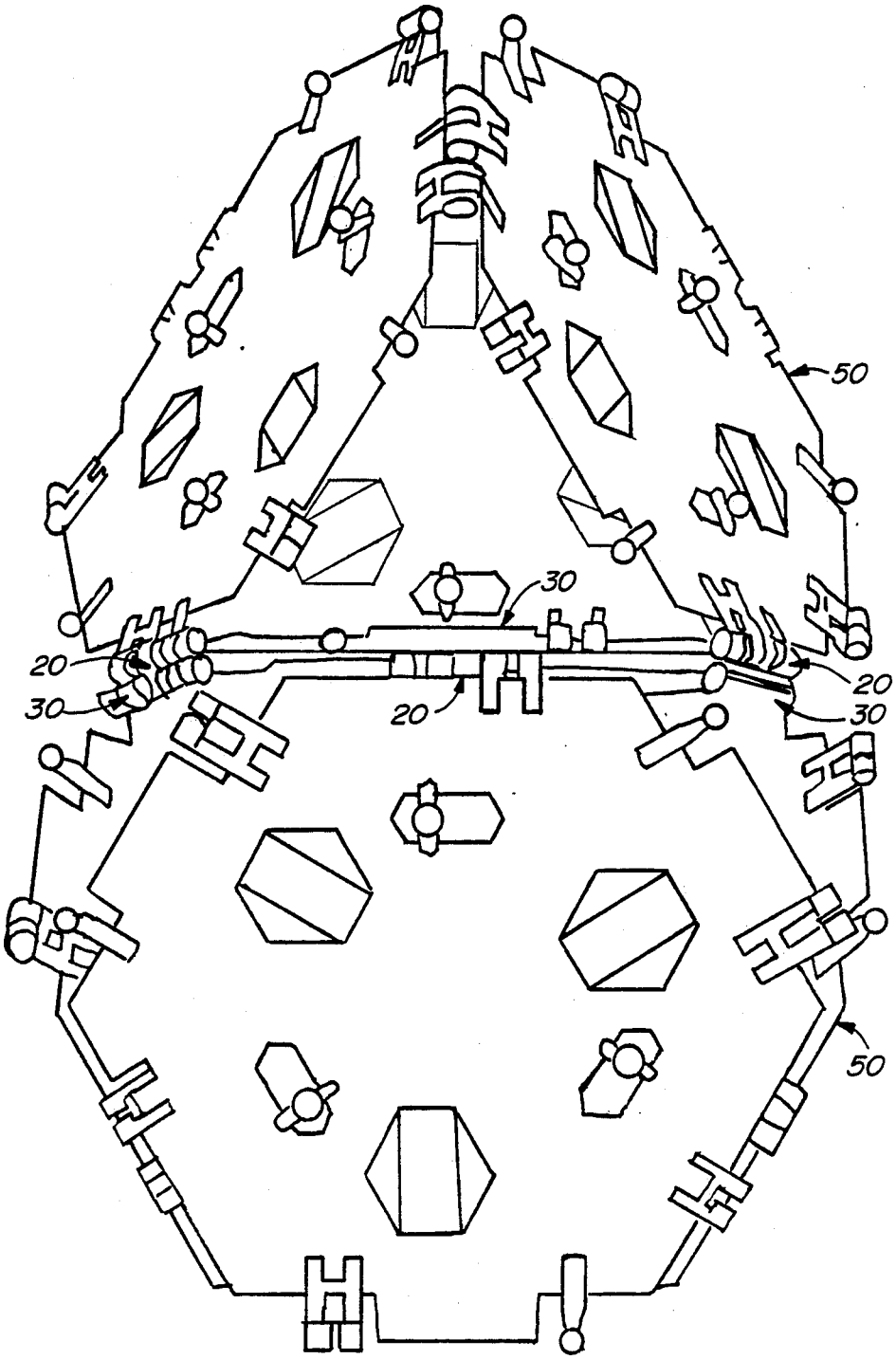
FIGS. 3–7 are views of several different ways that the truncated tetrahedron basic building units of FIG. 2 can be joined together.

FIG. 3 is a front elevation view of a pair of truncated tetrahedron basic building units 50 joined in rotated face-to-face engagement. In this arrangement, the face connectors of the two facing basic building pieces (not visible) engage each other while the various piece connectors 20 and unit connectors 30 of the facing basic building pieces do not engage each other.

Figure 4:
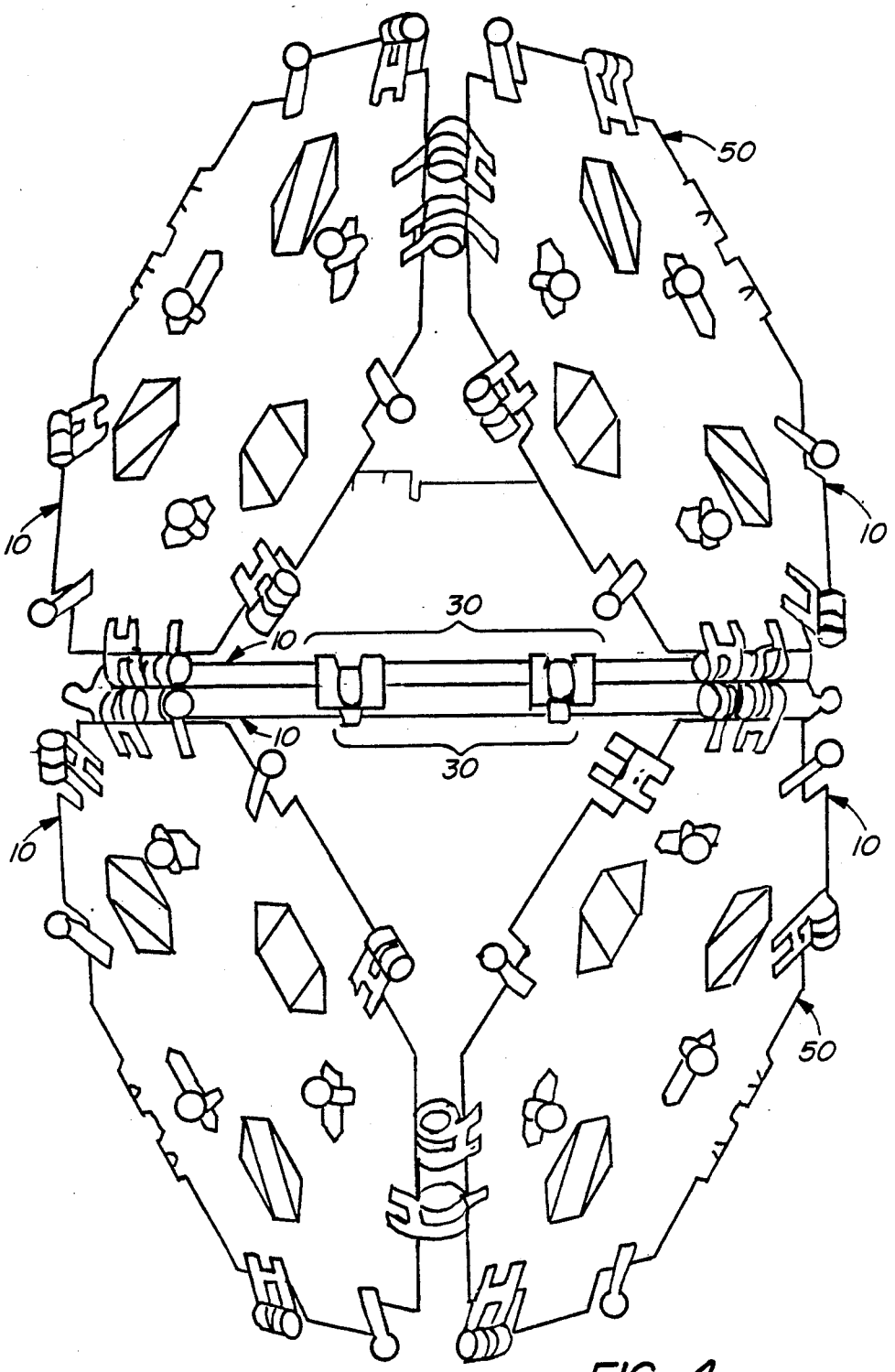

FIG. 4 is a front elevation view of a pair of truncated tetrahedron basic building units 50 joined in face-to-face engagement. In this view, respective unit connectors 30 can be seen to be connected to enable this "pure" face-to-face engagement. The unit connectors 30 are preferably positioned on the hexagonal piece 10 so that they occupy space and make their connection on the plane of the piece. This enables the unit connectors to "hinge" to a zero-degree included angle, allowing the unit connectors to double as face connectors in this type of face-to-face engagement.

Figure 5:
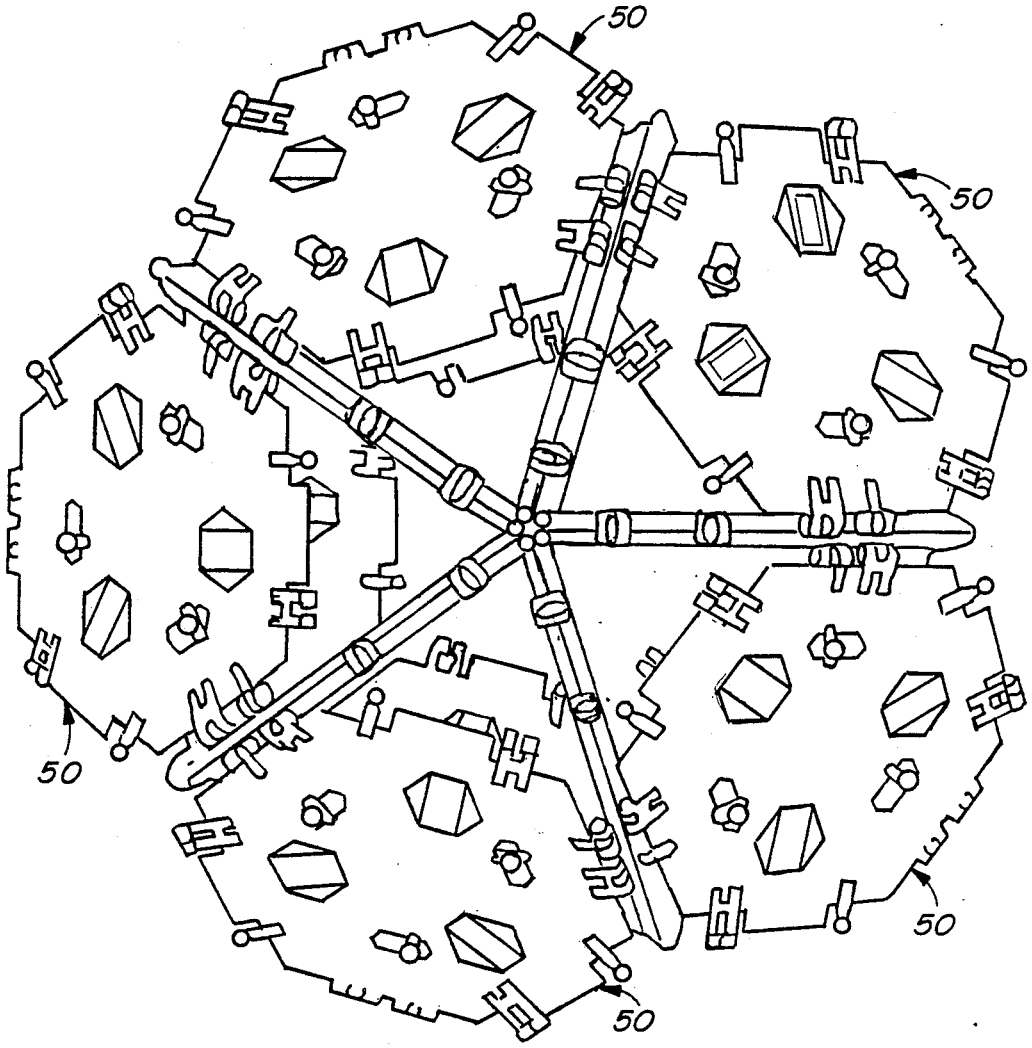

FIG. 5 is a front elevation view of a series of five truncated tetrahedron basic building units 50 joined in face-to-face engagement. This figure illustrates that by successive face-to-face engagement of the truncated tetrahedron basic building units (compare with FIG. 4), the resultant structure begins to "wrap" around back upon itself to form a circular arrangement. Continued in this pattern, twenty truncated tetrahedrons would form an internally "filled" truncated icosahedron (see FIG. 13, infra).

Figure 6:
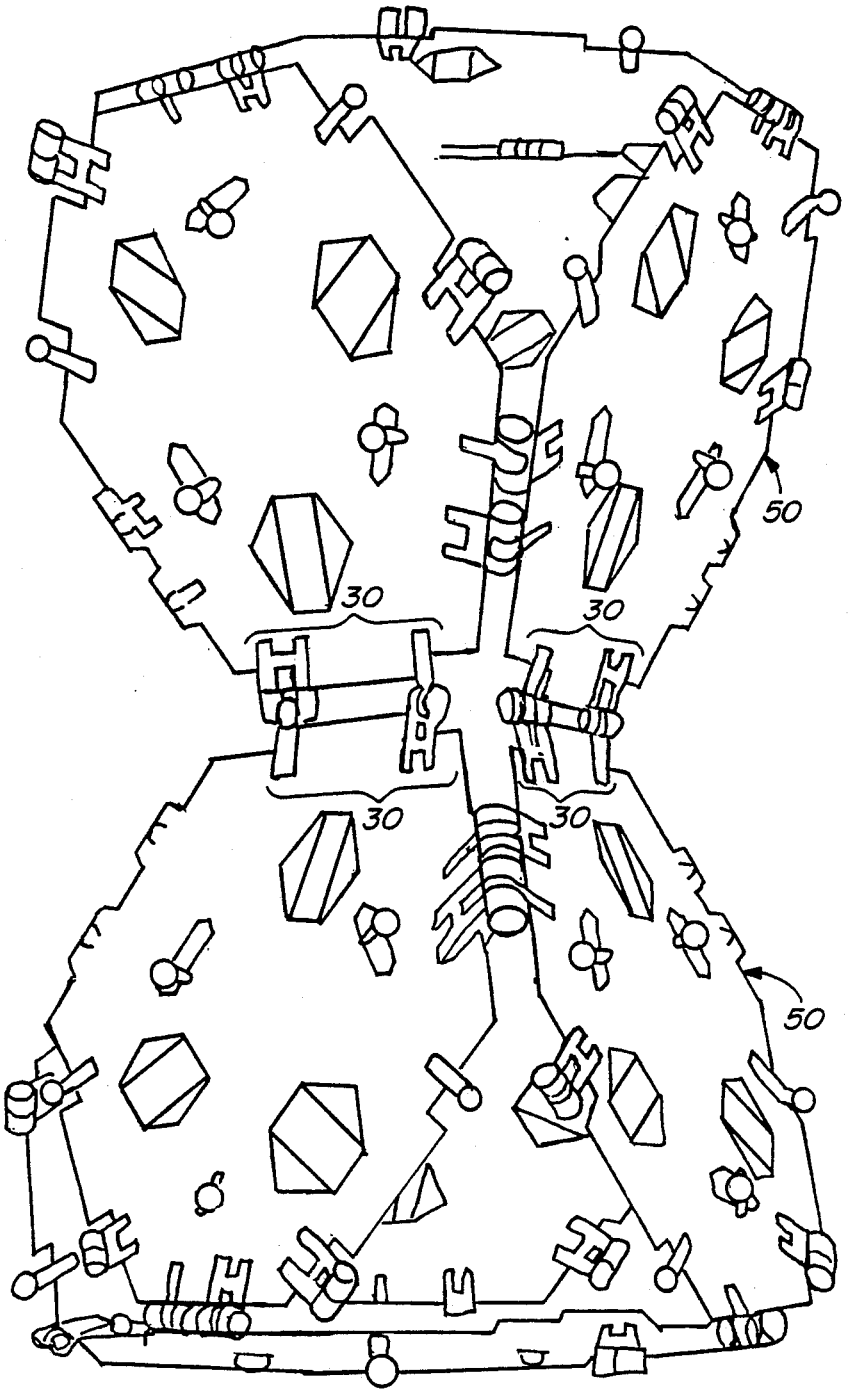

FIG. 6 is a front elevation view of a pair of truncated tetrahedron basic building units 50 joined in end-to-end engagement. Here, the unit connectors 30 of the units 50 enable the engagement of the truncated surfaces of these two identical basic building units.

Figure 7:
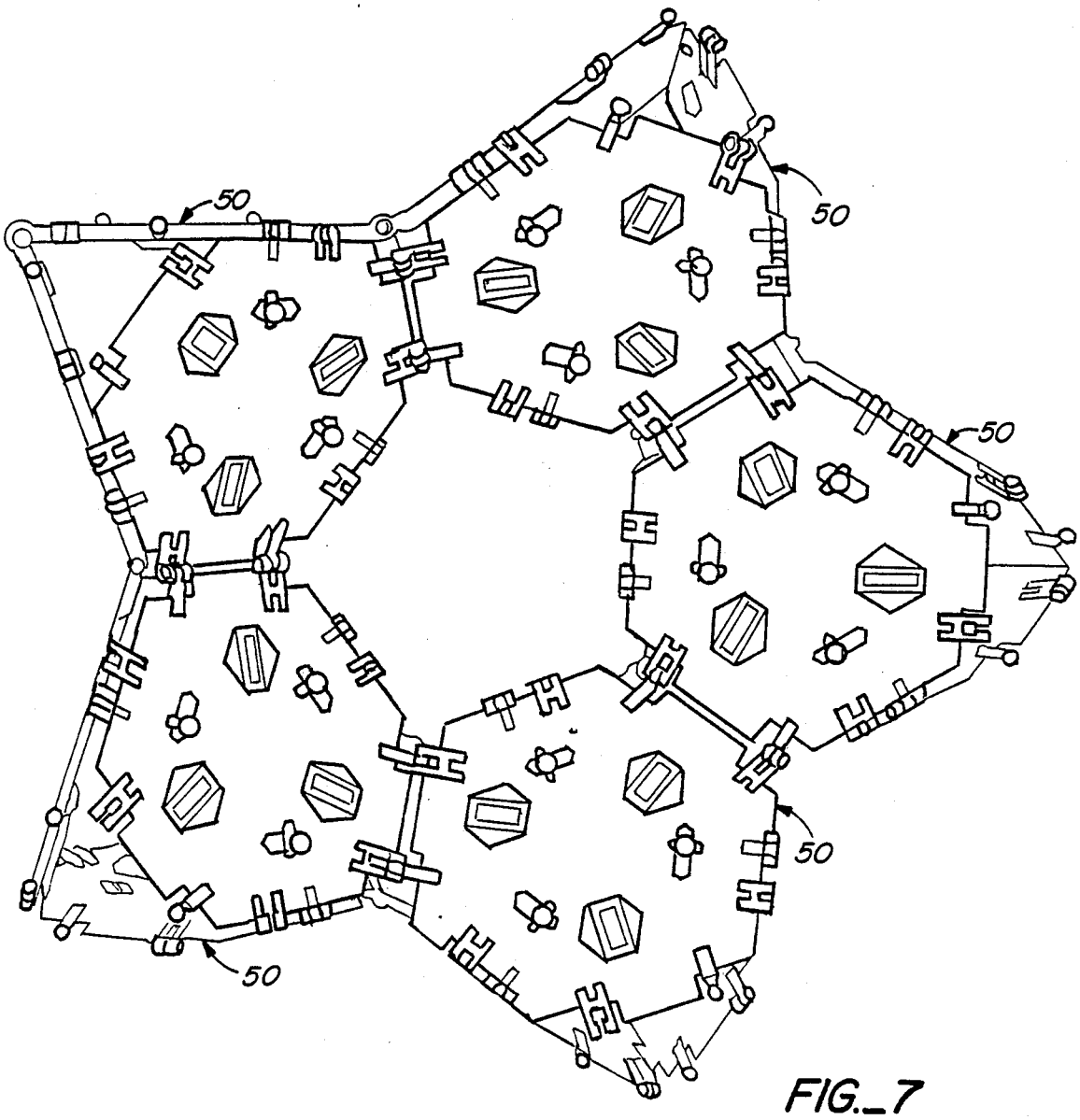

FIG. 7 is front elevation view of a series of five truncated tetrahedron basic building units 50 joined in end-to-end engagement. This figure illustrates that by successive end-to-end engagement of the truncated tetrahedron basic building unit (compare with FIG. 6), the resultant structure begins to "wrap" around back upon itself to form a circular arrangement, analogous to the situation illustrated in FIG. 5, supra. In fact, the structures of FIG. 5 and FIG. 7 would rest directly together in rotated face-to-face engagement of each of the five constituent truncated tetrahedrons.

Figure 8:
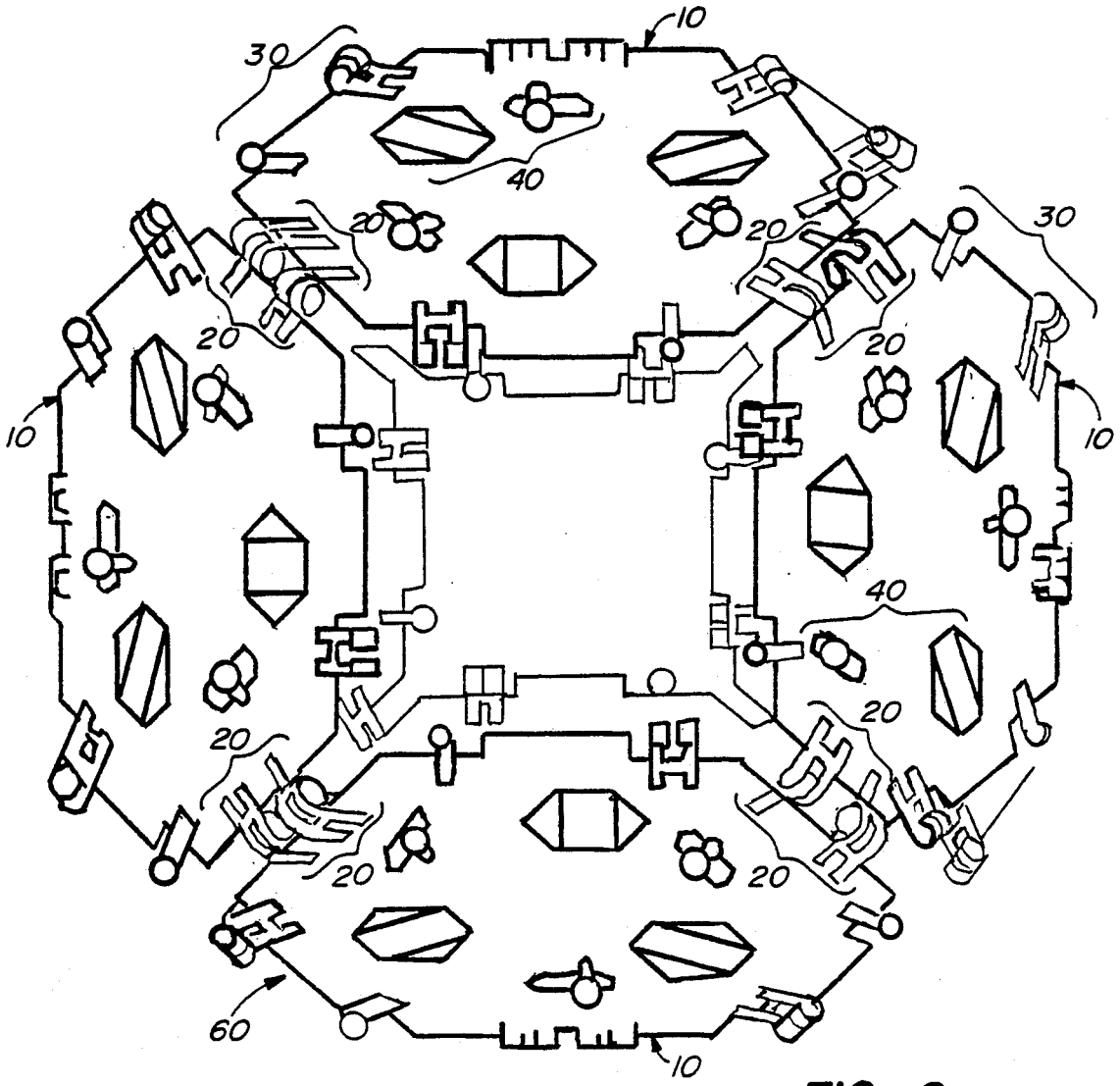
FIG. 8 is a front elevation view of a truncated octahedron basic building unit created from the connection of eight hexagonal basic building pieces of FIG. 1.

FIG. 8 is a front elevation view of a truncated octahedron basic building unit 60 created from the connection of eight hexagonal basic building pieces 10. As was the case with the truncated tetrahedron (FIG. 2), this structure is made from joining only the piece connectors 20 of the respective basic building pieces, leaving the unit connectors 30 and the face connectors 40 free for subsequent joining.

Figure 9:
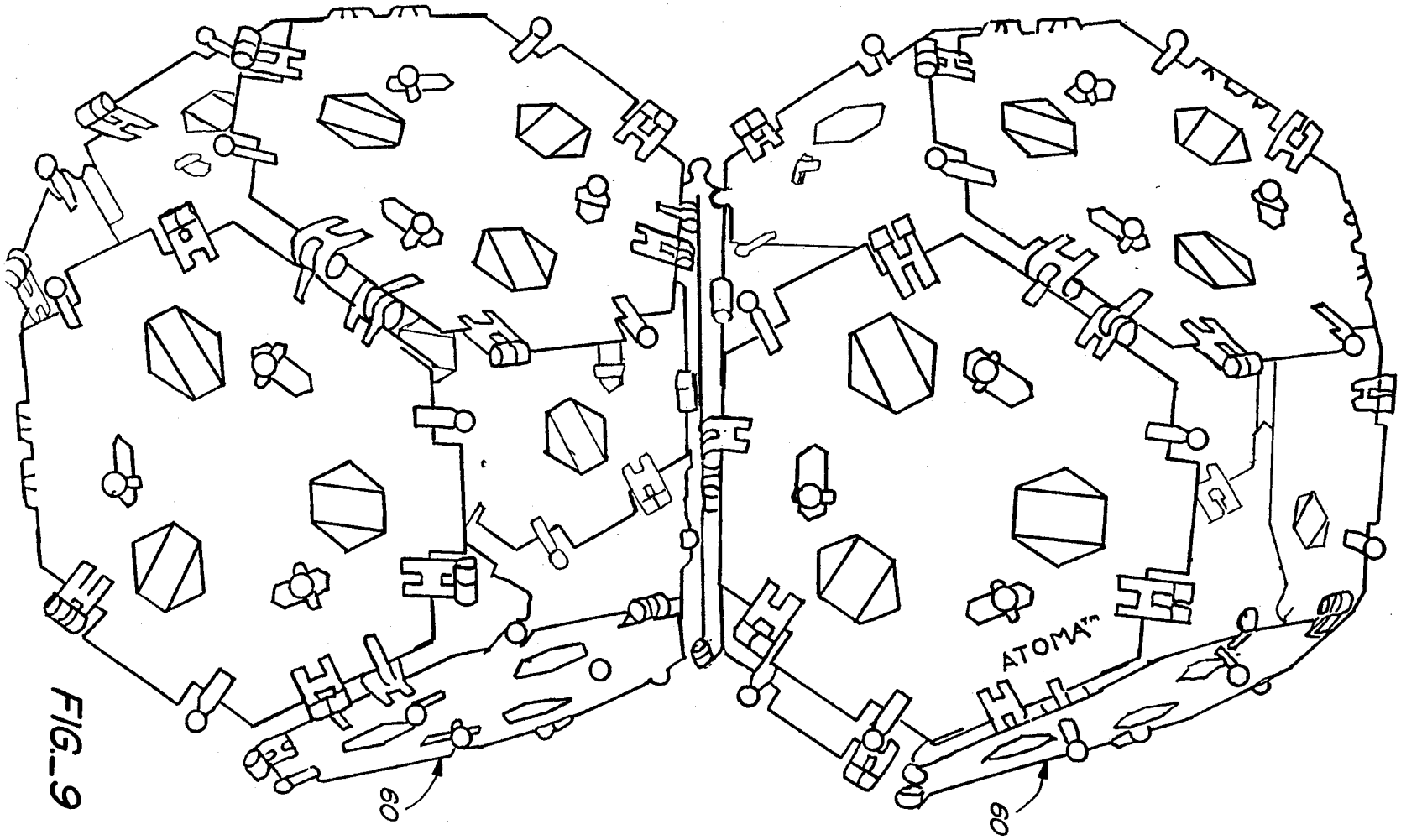
FIGS. 9–11 are views of several different ways that the truncated octahedron basic building units of FIG. 8 can be joined together.

FIG. 9 is a front elevation view of a pair of truncated octahedron basic building units 60 joined in rotated face-to-face engagement.

Figure 10:
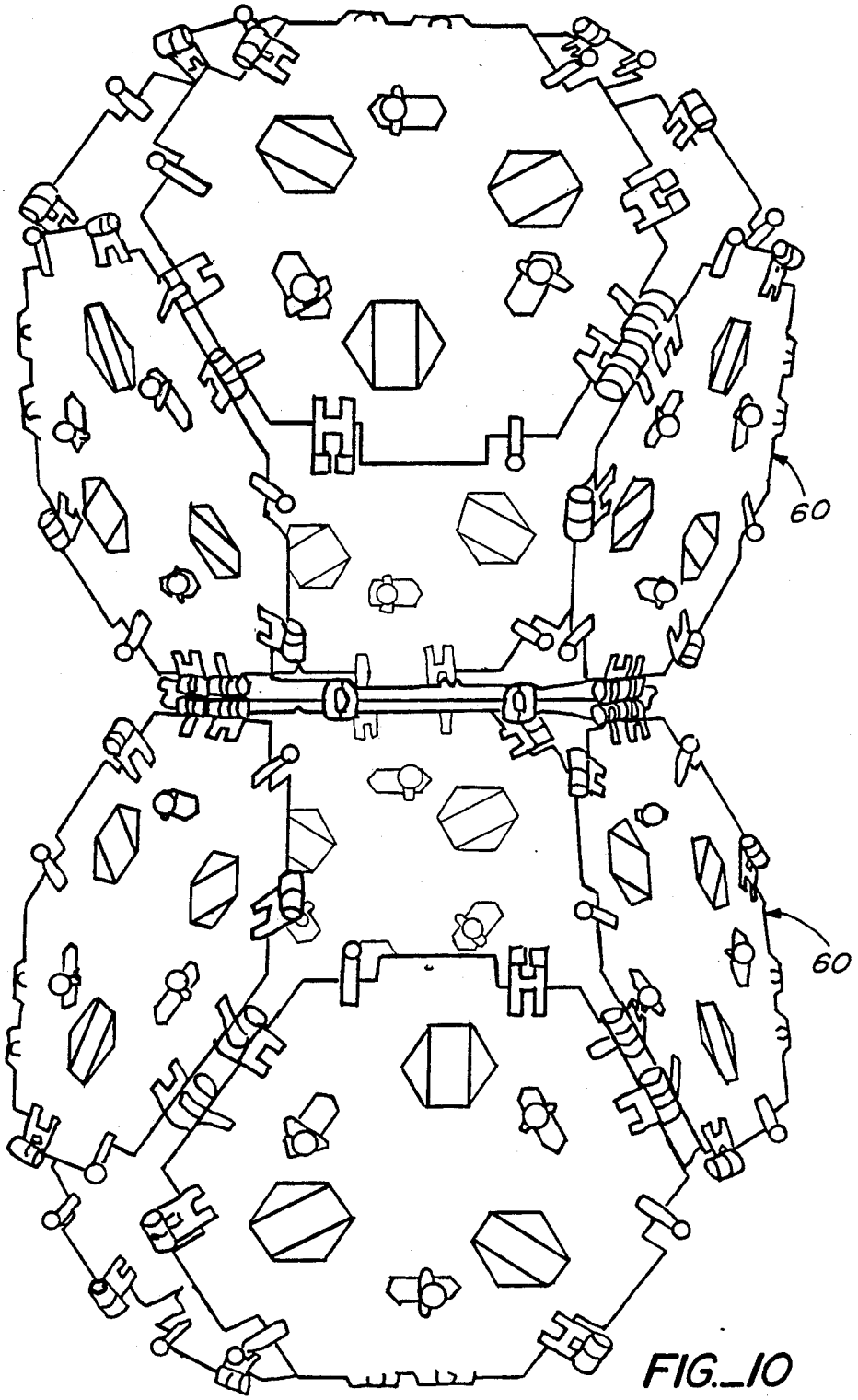

FIG. 10 is a front elevation view of a pair of truncated octahedron basic building units 60 joined in face-to-face engagement.

Figure 11:
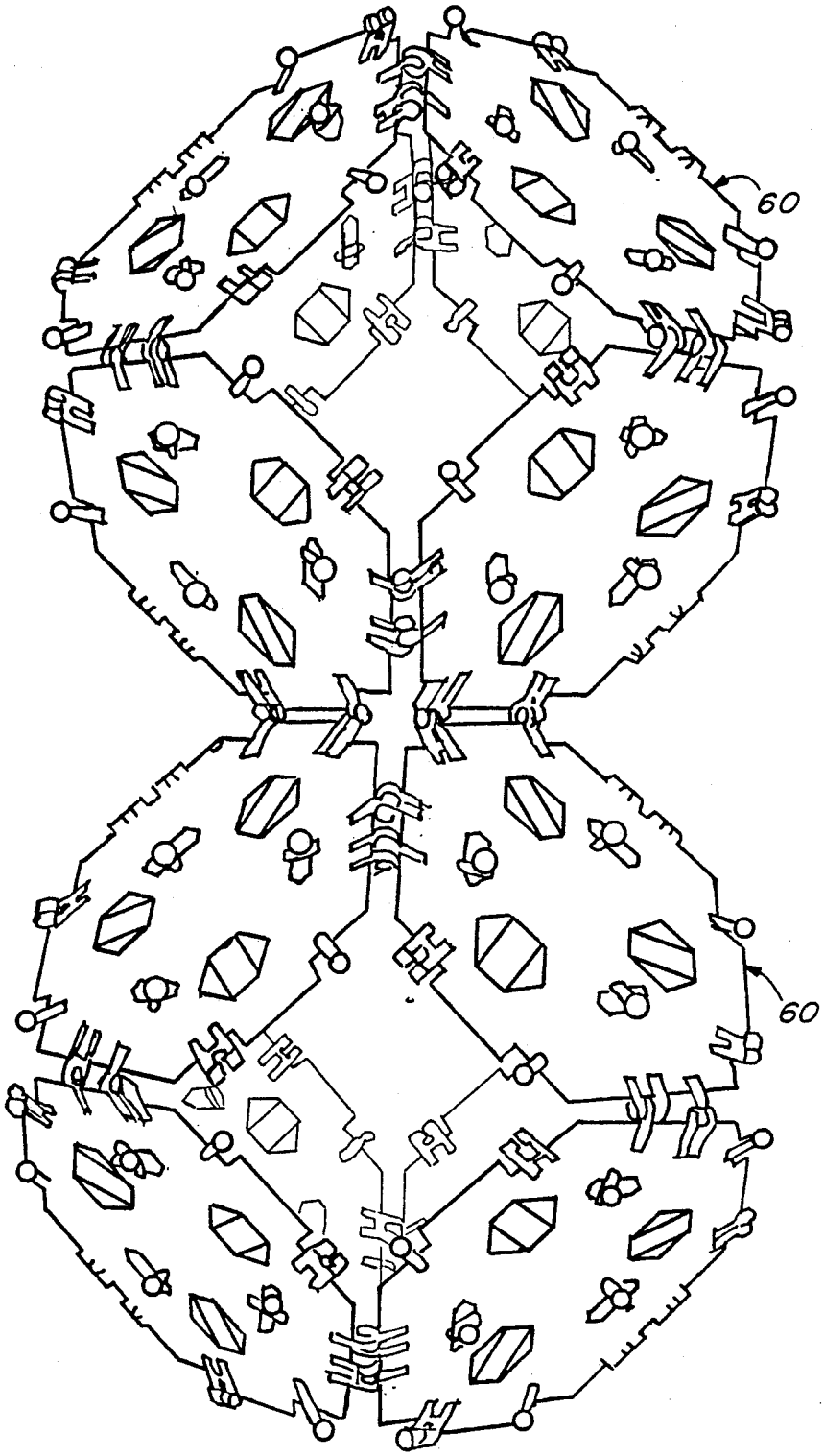

FIG. 11 is a front elevation view of a pair of truncated octahedron basic building units 60 joined in end-to-end engagement.

Figure 12:
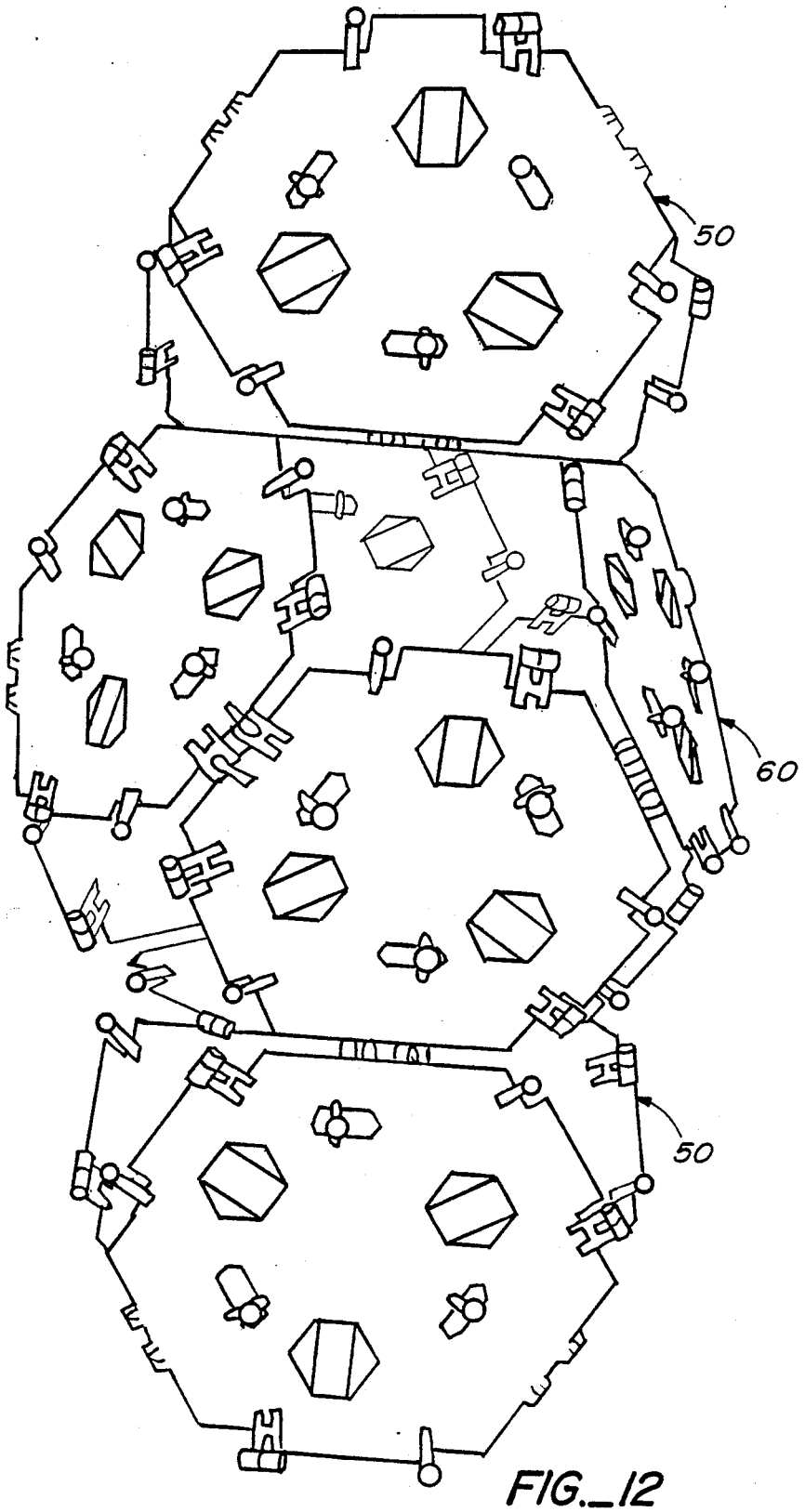
FIG. 12 is a front elevation view of a pair of truncated tetrahedron basic building units joined to opposite sides of a single truncated octahedron basic building unit, one in rotated face-to-face engagement, and the other in face-to-face engagement.

FIG. 12 is a front elevation view of a pair of truncated tetrahedron basic building units 50 joined to opposite sides of a single truncated octahedron basic building unit 60, one in rotated face-to-face engagement, and the other in face-to-face engagement. This figure illustrates the modular interconnectivity of different types of the basic building units with one another through the use of the face connectors. This feature is significant in that enables the user to make any number of modules, in any shape, that will be immediately connectable in this fashion.

Figure 13:
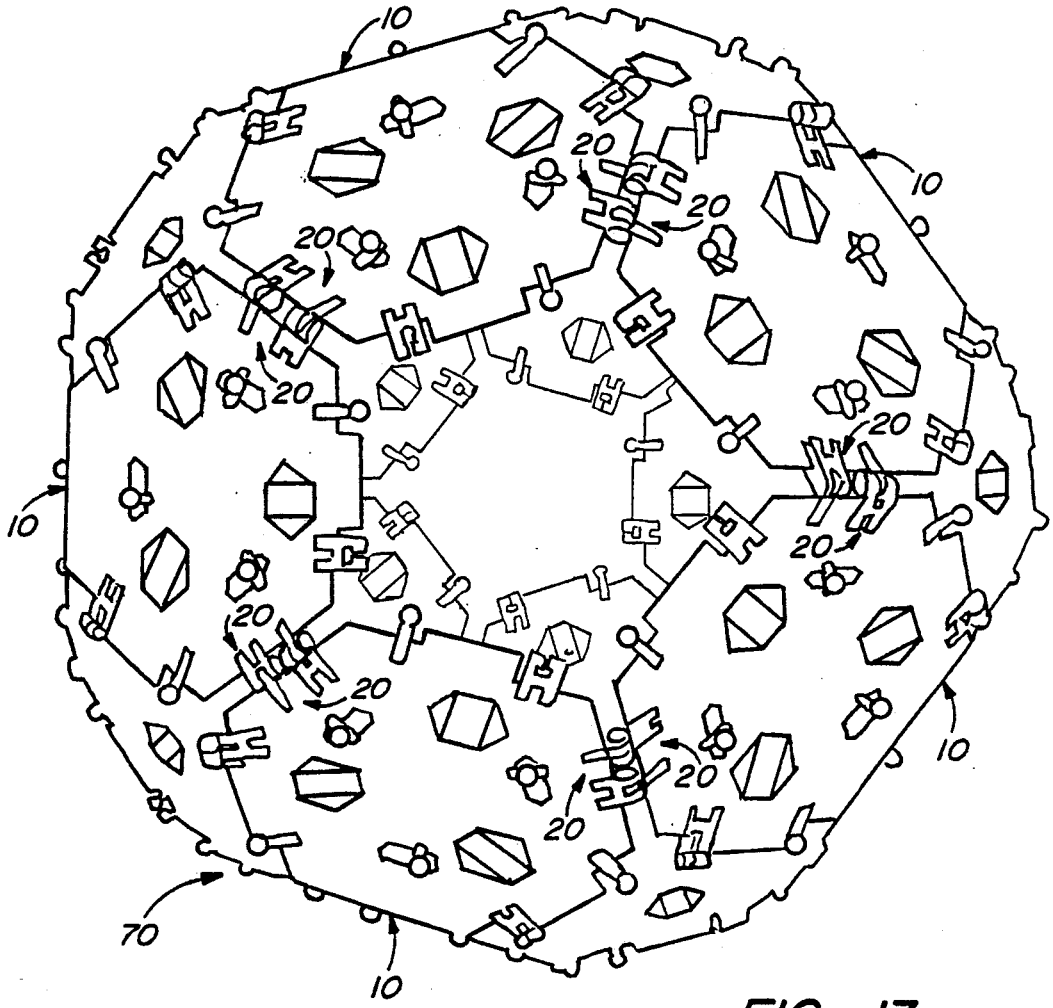
FIG. 13 is a front elevation view of a truncated icosahedron basic building unit created from the connection of twenty hexagonal basic building pieces of FIG. 1.

FIG. 13 is a front elevation view of a truncated icosahedron basic building unit 70 created from the connection of twenty hexagonal basic building pieces 10. The truncated icosahedron, like the truncated octahedron (FIG. 8) and truncated tetrahedron (FIG. 2), is made by joining only the piece connectors 20 of the respective basic building pieces.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A model building system comprising:

a plurality of flat, generally hexagonal members each having six edge portions and a first surface;

piece connector fastening means carried on three alternate edge portions of each of said hexagonal members, each piece connector conditioned for releasable engagement with the piece connector of another hexagonal member to join said members in edge-to-edge engagement;

unit connector fastening means carried on the three alternate edge portions of each of said hexagonal members not occupied by said piece connectors, each unit connector conditioned for releasable engagement with the unit connector of another hexagonal member to join said members in edge-to-edge engagement; and face connector fastening means carried on each of said hexagonal members first surface, each face connector conditioned for releasable engagement with the face connector of another hexagonal member to join said members in face-to-face engagement;

wherein said piece connectors are not engageable with said unit connectors or said face connectors, and said unit connectors are not engageable with said face connectors.

2. The model building system of claim 1 wherein said piece connector edge-to-edge engagement enables hinged movement of said joined member from coplanarity to either side of non-coplanarity.

3. The model building system of claim 1 wherein said unit connector edge-to-edge engagement enables hinged movement of said joined members from coplanarity to either side of non-coplanarity.

4. The model building system of claim 1 having a first hexagonal member and a second hexagonal member, wherein said face connector joins said members in face-to-face engagement only when the piece connectors of said first hexagon member are positioned proximate the unit connectors of said second hexagonal member.

5. The model building system of claim 1 having a first hexagonal member and a second hexagonal member, wherein said face connector joins said members in face-to-face engagement only when the piece connectors of said first hexagonal member are positioned proximate the unit connectors of said second hexagonal member, and when the unit connectors of said first hexagonal member are positioned proximate the unit connectors of said second hexagonal member, said unit connectors enable joining of said first and second hexagonal members in face-to-face engagement.

6. The model building system of claim 1 wherein four of said hexagonal members joined together in edge-to-edge engagement by said piece connectors form a truncated tetrahedron.

7. The model building system of claim 1 wherein eight of said hexagonal members joined together in edge-to-edge engagement by said piece connectors form a truncated octahedron.

8. The model building system of claim 1 wherein twenty of said hexagonal members joined together in edge-to-edge engagement by said piece connectors form a truncated icosahedron.

9. A model building piece comprising:

a flat, generally hexagonal member having six edge portions and a first surface;

piece connector fastening means carried on three alternate edge portions of said hexagonal member, each piece connector conditioned for releasable engagement with a piece connector of another similar hexagonal member;

unit connector fastening means carried on the three alternate edge portions of said hexagonal member not occupied by said piece connectors, each unit connector conditioned for releasable engagement with a unit connector of another similar hexagonal member; and face connector fastening means carried on said hexagonal member first surface, each face connector conditioned for releasable engagement with a face connector of another similar hexagonal member;

wherein said piece connectors, said unit connectors, and said face connectors are only engageable with respective piece connectors, unit connectors, and face connectors of similar hexagonal members.

10. The model building piece of claim 9 wherein said piece connectors comprise a ball and socket connection system.

11. The model building piece of claim 9 wherein said unit connectors comprise a ball and socket connection system.

12. The model building piece of claim 9 where said face connectors comprise a ball and socket connection system.

13. The model building piece of claim 9 wherein said piece is constructed of a clear plastic material.

14. The model building piece of claim 9 wherein said piece is constructed of a pigmented plastic material.

* * * * *